United States Patent [19]

Yamamoto et al.

[11] Patent Number: 5,073,468

[45] Date of Patent: Dec. 17, 1991

[54] METHOD OF FORMING ELECTROPHOTOGRAPHIC IMAGE

[75] Inventors: Tadao Yamamoto, Tokyo; Tetsuya Abe, Tama; Masaaki Dohi, Chofu; Shinichi Hisatomi, Higashimurayama; Mitsugu Oishi, Kodaira; Toshiro Honda, Mitaka; Mitsuo Hayashi, Hamura; Takeo Hirono, Akishima, all of Japan

[73] Assignees: Casio Computer Co., Ltd.; Casio Electronics Manufacturing Co., Ltd., both of Tokyo, Japan

[21] Appl. No.: 361,594

[22] Filed: Jun. 5, 1989

[30] Foreign Application Priority Data

| | | | |
|---|---|---|---|
| Jun. 10, 1988 | [JP] | Japan | 63-143116 |
| Sep. 19, 1988 | [JP] | Japan | 63-234467 |
| Sep. 27, 1988 | [JP] | Japan | 63-241681 |
| Oct. 18, 1988 | [JP] | Japan | 63-262620 |
| Oct. 18, 1988 | [JP] | Japan | 63-262621 |
| Oct. 28, 1988 | [JP] | Japan | 63-272729 |
| Oct. 28, 1988 | [JP] | Japan | 63-272730 |
| Oct. 28, 1988 | [JP] | Japan | 63-272731 |
| Dec. 9, 1988 | [JP] | Japan | 63-311352 |

[51] Int. Cl.[5] ..... G03G 9/00; G03G 21/00

[52] U.S. Cl. ..... 430/110; 430/111; 430/125

[58] Field of Search ..... 430/110, 125, 111

[56] References Cited

U.S. PATENT DOCUMENTS

| | | | |
|---|---|---|---|
| 4,087,170 | 5/1978 | Sawaoka et al. | 355/3 |
| 4,265,998 | 5/1981 | Barkley | 430/125 |
| 4,338,391 | 6/1982 | Nacci et al. | 430/122 |
| 4,380,579 | 4/1983 | Matsumoto et al. | 430/126 |
| 4,389,113 | 6/1983 | Matsumoto et al. | 355/326 X |
| 4,578,337 | 3/1986 | Oka et al. | 430/107 |
| 4,647,522 | 3/1987 | Lu | 430/110 |
| 4,652,509 | 3/1987 | Shirose et al. | 430/110 |
| 4,737,433 | 4/1988 | Rimai et al. | 430/126 |
| 4,746,589 | 5/1988 | Haneda et al. | 430/111 |
| 4,908,576 | 11/1990 | Maruta et al. | 430/110 |
| 4,933,251 | 6/1990 | Ichimura et al. | 430/109 |
| 4,933,253 | 6/1990 | Aoki et al. | 430/110 |
| 4,943,505 | 7/1990 | Aoki et al. | 430/109 |

FOREIGN PATENT DOCUMENTS

| | | | |
|---|---|---|---|
| 3530909 | 3/1986 | Fed. Rep. of Germany | 430/125 |
| 54-109842 | 8/1979 | Japan . | |
| 56-46271 | 4/1981 | Japan . | |
| 62-226173 | 10/1987 | Japan . | |

OTHER PUBLICATIONS

Stephen F. Pond, "Toner Mixture to Reduce Background Transfer Effects," *Xerox Disclosure Bulletin*, vol. 2, No. 2, Sep./Oct. '77, p. 17.

*Primary Examiner*—Marion E. McCamish
*Assistant Examiner*—S. Crossan
*Attorney, Agent, or Firm*—Nixon & Vanderhye

[57] ABSTRACT

A method of forming an image without cleaning on the basis of repeated electrophotographic process cycles. Each process cycle includes charging a surface of a photosensitive drum to a predetermined polarity, and irradiating the charged surface of the photosensitive drum with light which carries image information, thereby forming a latent image corresponding to the image information. The latent image is visualized by using a dry developer material, and the visualized image is transferred from the surface of the photosensitive drum onto a transfer medium. The developer material contains a transfer accelerator (hydrophobic silica or light-transmitting fine powder) for improving efficiency for transfer of the visualized image onto the transfer medium.

4 Claims, 5 Drawing Sheets

METHOD OF FORMING ELECTROPHOTOGRAPHIC IMAGE

BACKGROUND OF THE INVENTION

1. Field of the Invention

The present invention relates to a method of electrophotographically forming an image by using a dry developer material and, more particularly, to a method of stably forming an excellent electrophotographic image without performing cleaning.

2. Description of the Related Art

Image formation based on electrophotographic processes includes uniform charging of the surface of a photosensitive drum, formation of a latent image upon exposure of the charged surface, visualization (development) of the latent image with a toner, and transfer of the visualized image onto a paper sheet. The sheet onto which the visualized image has been transferred is separated from the photosensitive drum, and the transferred image is fixed. Thereafter, the copied sheet is delivered outside the system. The photosensitive drum after image transfer is prepared for the next image formation cycle.

In an apparatus for performing the above electrophotographic processes, since transfer efficiency of the visualized image onto the sheet is not 100%, some of toner particles remain on the surface of the photosensitive drum after image transfer is performed. The residual toner particles adversely affect image and formation must be removed prior to the next image formation cycle. In order to remove these residual toner particles, an exclusive cleaner has been used to scrape the residual toner particles from the photosensitive drum after the visualized image is transferred to the sheet. However, use of the exclusive cleaner is not preferable because it renders an image formation apparatus bulky.

In order to solve the above problem, there is proposed an image forming apparatus comprising a developing unit having a cleaner function. In an apparatus of this type, charging, exposure, development by a cleaner/developing unit, and transfer are performed upon one revolution of the photosensitive drum. The photosensitive drum is further rotated by one revolution to cause the cleaner/developing unit to remove the residual toner. In this apparatus, however, in order to prevent an afterimage from being formed on the non-cleaned surface of the photosensitive drum once the image is formed, the circumferential length of the photosensitive drum must be longer than the length of a sheet having a maximum size. For example, when the maximum sheet size is a B4 size, the length of this sheet is 364 mm. In this case, the circumferential length of the photosensitive drum is a sum of 364 mm and an extra length (normally, about 25 mm). This circumferential length corresponds to a diameter of about 120 mm, thus requiring a large photosensitive drum. In addition, when images are continuously formed by using this apparatus, one additional revolution of the drum to remove the residual toner prolongs a waiting period of the next copying sheet, thus lowering an image formation speed.

In order to eliminate the drawback of the above image forming system, there are proposed systems for performing development while residual toner particles are removed, as described in Japanese Patent Disclosure (Kokai) Nos. 54-109842 and 62-226173 and U.S. Pat. No. 4,265,998. Such a system does not require an exclusive cleaner, and cleaning need not be an independent step. Therefore, continuous image formation can be performed using a normal small-diameter photosensitive drum without causing the next copying sheet to wait for a period of time. However, an image forming apparatus employing the above system inevitably has a complicated developing unit and its associated structure as compared with the conventional electrophotographic image forming apparatus.

As described above, various improvements have been made for the conventional methods and apparatus for forming electrophotographic images. However, these improvements are based on the premise that toner particles remain on the surface of the photosensitive drum after the visualized image is transferred to the sheet.

SUMMARY OF THE INVENTION

It is, therefore, an object of the present invention to provide a method of stably and relatively rapidly forming excellent electrophotographic images without causing image quality degradation such as an afterimage and without performing cleaning It is another object of the present invention to provide a method of forming an electrophotographic image wherein visual image transfer efficiency of substantially 100% can be maintained for a relatively long period of time.

In order to achieve the above objects of the present invention, there is provided a method of forming an image without cleaning on the basis of repeated electrophotographic process cycles, each process cycle including the steps of:

charging a surface of a photosensitive body to a predetermined polarity;

irradiating the charged surface of the photosensitive body with light carrying image information, thereby forming a latent image corresponding to the image information;

visualizing the latent image by using a dry developer material; and transferring the visualized image from the surface of the photosensitive body onto a transfer medium, wherein the developer material contains a transfer accelerator for improving efficiency of transfer of the visualized image onto the transfer medium.

DETAILED DESCRIPTION OF THE PREFERRED EMBODIMENTS

The present invention will be described in detail with reference to the accompanying drawings.

Figure 1:
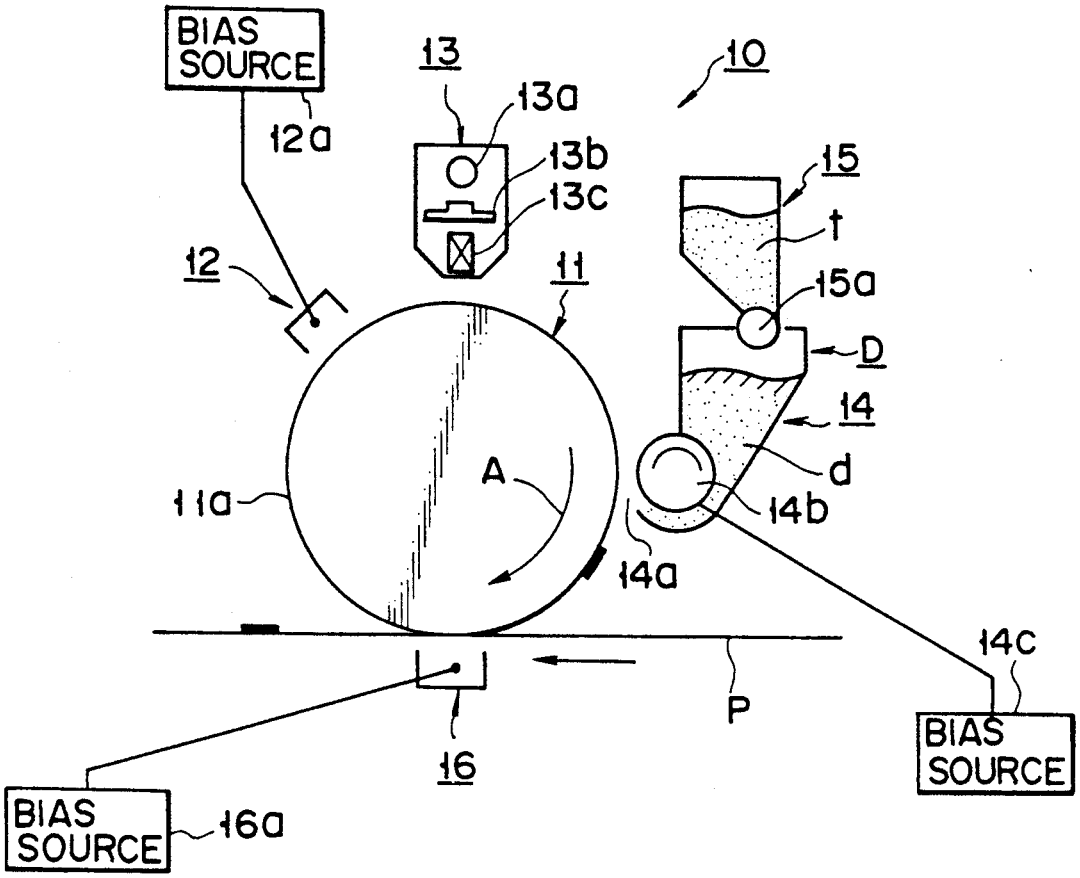
FIG. 1 is a schematic view showing a main part of a liquid crystal printer which employs a method of forming an electrophotographic image of the present invention.

FIG. 1 schematically shows the main part of a liquid crystal printer suitable for practicing a method of forming an electrophotographic image according to the present invention. Referring to FIG. 1, a photosensitive drum 11 rotatably driven in a direction of an arrow A is arranged at the center portion of a liquid crystal printer 10. The photosensitive drum 11 is grounded. A charger 12 for uniformly charging a surface 11*a* of the photosensitive drum 11 to a predetermined potential, and a liquid crystal recording head 13 for forming a latent image corresponding to image information by irradiation of the charged photosensitive drum surface 11*a* with light corresponding to the image information are sequentially arranged along the surface 11*a* of the photosensitive drum 11. The charger 12 is connected to a bias power source 12*a* having a predetermined polarity (negative polarity in this embodiment).

The liquid crystal recording head 13 includes a liquid crystal shutter panel 13*b* having a large number of microshutters (not shown) thereon, a light source 13*a* for emitting light to the shutter panel 13*b*, and a focusing lens array 13*c* for focusing light transmitted through the shutter panel 13*b* (light carrying image information) onto the charged photosensitive drum surface 11*a*.

A developing device D for applying a toner to the latent image formed on the photosensitive drum surface 11*a* to form a toner image is arranged on the downsteam side of the liquid crystal head 13 in the rotational direction of the photosensitive drum 11. The developing device D includes a developing unit 14 and a toner hopper 15 arranged above the developing unit 14 and performs reversal development using a two-component type developer material. An initial charge of a two-component type developer material d containing a toner and a carrier, together with a transfer accelerator (described later more in detail) having a predetermined content with respect to the content of the toner is stored in the developing unit 14. A development sleeve 14*b* is rotatably arranged at a supply port 14*a* of the developing unit 14 facing the surface 11*a* of the photosensitive drum 11. The development sleeve 14*b* is connected to a developing bias power source 14*c*. The developer material d is carried on the surface of the development sleeve 14*b* upon rotation of the development sleeve 14*b*. The developer material d is conveyed to a developing position closest to the surface 11*a* of the photosensitive drum 11, thereby developing the latent image.

A replenishing toner t is stored in the toner hopper 15. A toner replenishing roller 15*a* is located at a replenishing port of the toner hopper 15 facing the upper portion of the developing unit 14. An amount of the replenishing toner to the developing unit 14 is adjusted by controlling rotation of the roller 15*a*.

A transfer unit 16 is arranged on the downstream side of the developing device D to transfer a developed toner image to a paper sheet p. The transfer unit 16 is connected to a bias power source 16*a* having a polarity (positive in this embodiment) opposite to that of the bias power source 12*a* connected to the charger 12.

A method of forming an electrophotographic image according to the present invention will be exemplified by the liquid crystal printer shown in FIG. 1.

According to the present invention, the cleaner and the cleaning step are omitted by maintaining 100% transfer efficiency. Thus, a mechanism for transferring a toner image to the sheet in the transfer step will be described below.

Figure 2:
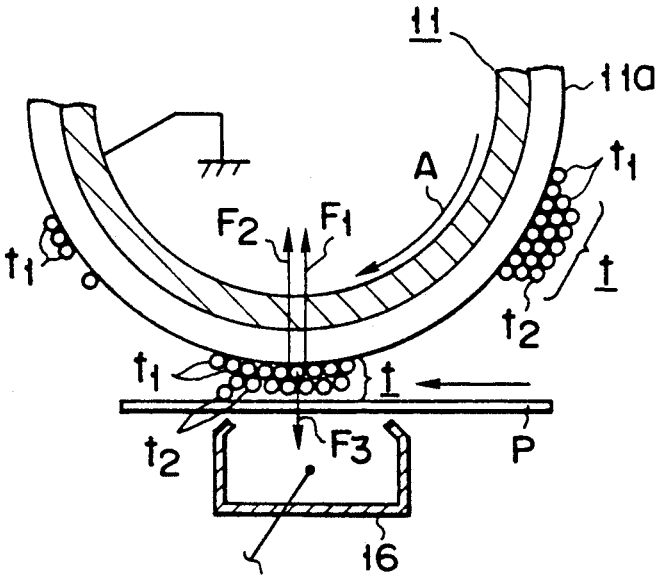
FIG. 2 is a schematic view for explaining the step of transferring a toner image in the liquid crystal printer shown in FIG. 1.

As shown in FIG. 2, of the toner particles carried by the photosensitive drum 11, a first toner layer t1 directly attracted to the photosensitive drum surface 11*a* receives the following two physical forces:

$$\text{Van der Waals Force: } F1 = h\omega \cdot \gamma / 8\pi Z^{\beta} \quad (1)$$

$$\text{Image Force: } F2 = (q^2/4\pi\epsilon 0(2r)^2) \times \{(\epsilon p\text{-}1)/(\epsilon p+1)\} \quad (2)$$

where

- $h\omega$ : Lifshitz-Van der Waals constant
- $\gamma$: toner particle radius
- Z : gap between the toner and the photosensitive body surface
- $\beta$ : coefficient
- q : toner charge
- $\epsilon 0$: vacuum dielectric constant
- $\epsilon p$: specific dielectric constant of the photosensitive body Assume that $\gamma=5$ ($\mu$m), Z=1 (nm), $\beta-2$ (at $Z \approx 1$ nm), q=26 ($\mu$c/g), $\epsilon O = 8.854 \times 10^{-12}$ ($q^2/N \cdot m^2$), and $\epsilon p = 3.4$. Substitutions of these values into equations (1) and (2) yield the following values:

$$F1 = 6.4 \times 10^{-3} \text{ (dyne)}$$

$$F2 = 0.9 \times 10^{-3}$$ According to these calculation results, it is apparent According to these calculation results, it is apparent that about 88% of the force for attracting the first toner layer t1 to the photosensitive drum surface 11*a* are given by the Van der Waals force F1.

A second toner layer t2 on the surface of the photosensitive drum 11 will be taken into consideration. In this case, a Van der Waals force F1 can be obtained under the same conditions as those of the first toner layer except for the gap Z (i.e., the gap between the toner and the photosensitive body). The gap Z between the second toner layer t2 and the surface of the photosensitive drum is equal to the diameter of each toner particle of the first toner layer t1, that is, can be considered as:

$$Z = 10\ \mu m$$

The Van der Waals force F1 for the second toner layer t2 is calculated by equation (1) in the same manner as in the first toner layer by using the gap $Z = 10\ \mu m$:

$$F1 = 6.4 \times 10^{-11}\ \text{(dyne)}$$

An image force F2 for the second toner layer t2 is calculated by equation (2) under the same conditions as those of the first toner layer except that $2r = 30\ \mu m$:

$$F2 = 1 \times 10^{-4}\ \text{(dyne)}$$

The attraction force for the second toner layer t2 to the surface to the photosensitive drum 11 is found to be greatly smaller than that of the first toner layer t1.

Each toner particle of the toner layer t is frictionally charged to a predetermined polarity (negative polarity in this embodiment) in the developing unit 14.

In the transfer step, a Coulomb force F3 generated by corona ions having a polarity (positive polarity in this embodiment) opposite to the toner particles and discharged from the transfer unit 16 to the lower surface of the sheet p is applied to the toner layer t carried on the photosensitive body surface by the forces F1 and F2, in an opposite direction (i.e., a direction transferring the toner layer t to the sheet). Therefore, in order to transfer the toner layer t1 to the sheet p, the following equation must be established:

$$F3 > F1 + F2 \qquad (3)$$

In order to improve transfer efficiency (i.e., a ratio of the weight of toner particles transferred to the sheet to the weight of toner particles supplied for development), the force F3 at the left-hand side of equation (3) must be increased, or the forces F1 and F2 at the right-hand side must be decreased.

In order to increase the Coulomb force F3, a voltage applied to the transfer unit 16 is increased. However, when the transfer voltage is excessively increased, a transfer corona current is excessively increased and flows toward the photosensitive drum 11 through the sheet p. As a result, the polarity of the toner layer t is inverted to have the same polarity as that of the corona ions. This toner layer t receives an electrical field force along a direction (i.e., a direction to attract the toner particles to the photosensitive drum surface 11*a*) of the corona ions. Therefore, the toner cannot be transferred to the sheet. Therefore, the transfer voltage is generally set to have a proper magnitude so as to satisfy equation (3). In this case, the maximum transfer efficiency is about 80%, and about 20% of toner particles supplied for development are left on the photosensitive drum surface 11*a* as nontransferred toner particles. Therefore, cleaning is required.

A method of reducing the Van der Waals force F1, which is 88% of the forces F1 and F2 for retaining the toner layer t on the photosensitive drum surface will then be taken into consideration.

As is apparent from equation (1), the Van der Waals force F1 is determined by the Lifshitz-Van der Walls constant $h\omega$, the toner particle radius r, and the gap Z between the toner particle and the photosensitive drum surface. The toner particle radius r and the gap Z between the toner layer and the photosensitive drum surface greatly influence image quality such as an image density and are determined in consideration of image quality. In order to reduce the Van der Waals force F1, the Lifshitz-Van der Walls constant $h\omega$ must be reduced. The Lifshitz-Van der Waals constant $h\omega$ corresponds to bonding energy between the photosensitive drum surface and the toner and is given as a value depending on the surface free energy of each substance. The Lifshitz-Van der Waals constant $h\omega$ falls within the range of 1.5 to 2.0 eV between the toner and the photosensitive material. In order to reduce the Lifshitz-Van der Waals constant $h\omega$, the surface free energy of the toner must be reduced. For this purpose, the substances constituting the toner must be changed. The changes in substances are not suitable because they greatly influence image quality. According to the present invention, particles of another material having a small surface free energy are mixed with (added to) the toner, and the another material is made to be interposed between the photosensitive drum surface and the toner, thereby reducing the Lifshitz-Van der Waals constant $h\omega$.

When the particles of the another material are attached as the first layer, and the toner particles are attached as the second layer to the photosensitive drum surface, the attraction force of the second toner layer to the surface of the photosensitive drum is given as follows.

If a diameter of each of the another material particles is given as 0.1 $\mu m$, the following values are obtained from equations (1) and (2):

$$F1 = 6.4 \times 10^{-9}\ \text{(dyne)}$$

$$F2 \approx 0.9 \times 10^{-3}\ \text{(dyne)}$$

As is apparent from the above calculation results, the image force F2 is not reduced as compared with the case wherein the toner constitutes the first layer. However, the Van der Waals force F1 is extremely reduced. Therefore, when the particles of the another material described above constitute the first layer and the toner constitutes second and subsequent layers, transfer efficiency of the toner image can be increased to 100%. At the same time, imaging trouble such as formation of an afterimage by residual particles remaining on the photosensitive drum surface can be prevented.

The particles of the above another material mixed with the toner must have a low surface free energy. and also the physical properties of the material must not adversely affect the image quality. From these viewpoints, the present inventors made extensive studies and found that a silica powder and a light-transmitting fine powder were suitable for the above-mentioned another material (i.e., a transfer accelerator). The transfer accelerator will be described below.

Silica

Silica particles have been added to a developer material in the electrophotographic image formation process to improve fluidity of the developer material. There is no problem in the use of the silica particles in the developer material. The surface free energy of any substance including silica particles is known to be changed by a hydrophobic treatment, i.e., substitution of a hydrophilic group with a hydrophobic group. The present inventors made experiments to determine the relationship between the transfer efficiency and the degree of hydrophobicity by using silica particles having different degrees of hydrophobicity. Experimental results are summarized as follows.

EXPERIMENTAL 1

(Method)

A two-component type developer material having the following components was used to perform image formation by the printer of FIG. 1:

| | |
|---|---|
| Ferrite carrier (Cu—Zn—Mg; average particle size: 50–60 μm) | 225 parts by weight |
| *N type toner (average particle size: 12.5 μm) | 25 parts by weight |
| Silica particle (average particle size: 0.2–0.8 μm) | 0.125–0.25 parts by weight (0.5–1.0 wt % with respect to toner) |

Note:
*N type: electron acceptor type

In this case, the sheet used was an A4 size and was fed along its longitudinal direction. Developer material added with four types of silica particles having four different degrees of hydrophobicity and a developer material without silica particles were used to conduct the experiment, and transfer efficiency was measured. The potentials in the printer were set as follows:

Initial charging potential Vs ... −450 V
Background portion potential VH ... −300 V
Development bias potential VB ... −240 V
Exposed portion potential VL ... −20 V The diameter of the photosensitive drum was 30 mm.

(Results)

TABLE 1

| *Silica Tradename | No addition | N-20 | H-2000/4 | HVK21 | H-2000 |
|---|---|---|---|---|---|
| Type | — | Hydrophilic | Hydrophobic | Hydrophobic | Hydrophobic |
| Degree of Hydrophobicity | — | 0 | about 60% | about 70% | about 80% |
| Transfer Efficiency | 80% | 85% | 90% | 95% | 100% |

*Wacker Chemicals East Asia Corp.

From the results in Table 1, the hydrophobic silica apparently improved transfer efficiency. When the degree of hydrophobicity was increased, the transfer efficiency could be further improved because the surface free energy of silica was lowered by a hydrophobic treatment. In the electrophotographic image formation process practiced without using a cleaner, when a developer material added with H-2000 silica having the highest degree of hydrophobicity was used, a good image could be stably obtained without causing an afterimage phenomenon.

The H-2000 silica having the highest transfer efficiency in the above experiment was taken into consideration. In order to obtain an optimal addition ratio of the H-2000 silica, three developer materials a, b, and c having different H-2000 silica contents were prepared, and an experiment was performed as follows.

EXPERIMENT 2

The developer material a having the following components was used following the same procedures as in Experiment 1 to perform image formation so as to count the number of prints until an afterimage appeared:

| | |
|---|---|
| Ferrite carrier (Cu—Zn—Mg; average particle size: 50–60 μm) | 225 parts by weight |
| N type toner (average particle size: 12.5 μm) | 25 parts by weight |
| Hydrophobic silica (H-2000) (average particle size: 0.2–0.8 μm) | 0.125 parts by weight (0.5 wt % with respect to toner) |

No afterimage appeared until the number of prints was 1,000.

EXPERIMENT 3

The developer material b having the following components was used following the same procedures s in Experiment 1 to perform image formation so as to count the number of prints until an afterimage appeared:

| | |
|---|---|
| Ferrite carrier (Cu—Zn—Mg; average particle size: 50–60 μm) | 225 parts by weight |
| N type toner (average particle size: 12.5 μm) | 25 parts by weight |
| Hydrophobic silica (H-2000) (average particle size: 0.2–0.8 μm) | 0.188 parts by weight (0.75 wt % with respect to toner) |

No afterimage appeared until the number of prints was 2,500.

EXPERIMENT 4

The developer material c having the following components was used following the same procedures as in Experiment 1 to perform image formation so as to count the number of prints until an afterimage appeared:

| | |
|---|---|
| Ferrite carrier (Cu—Zn—Mg; average particle size: 50–60 μm) | 225 parts by weight |
| N type toner (average particle size: 12.5 μm) | 25 parts by weight |
| Hydrophobic silica (H-2000) (average particle size: 0.2–0.8 μm) | 0.25 parts by weight (1.0 wt % with respect to toner) |

No afterimage appeared until the number of prints was 4,000.

According to the above experimental result, when the electrophotographic image formation process without using a cleaner was performed using the developer material added with 1.0 wt%, with respect to a toner, (which did not adversely affect image formation) of the silica (H-2000) having an 80% degree of hydrophobicity, the afterimage did not appear until the number of prints was about 4,000. This developer material was found to be satisfactory for practical use.

That is, when hydrophobic silica particles having a degree of hydrophobicity of 80% or more are added to a developer material containing a toner, according to the present invention, 100% transfer efficiency can be maintained for a long period of time. As is known in the art, the degree of hydrophobicity indicates a ratio of substitution of H of a silanol group with an alkylsilyl group upon reaction between the silanol group on the surface of the silica particle and an organosilane as follows:

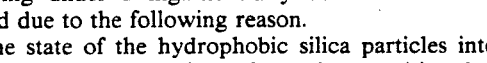

$$Si{-}OH + X{-}Si(CH_3)_3 \xrightarrow{-HX} Si{-}O{-}Si(CH_3)_3$$

In Experiment 4, when the number of prints exceeded 4,000, it was found that the transfer efficiency was gradually degraded to about 90% at which an afterimage appeared. At this stage, another problem such as image blurring under a high-humidity condition was also posed due to the following reason.

The state of the hydrophobic silica particles interposed between the surface of the photosensitive drum and the toner layer is changed upon repetition of printing, and the surface free energy of the hydrophobic silica is increased, thereby lowering the effect of reducing the Van der Waals force between the surface of the photosensitive drum and the toner particles. One of the causes may be given such that component materials of the ferrite carrier are attached to the surfaces of the hydrophobic silica particles.

In the conventional carrier, a large number of very fine powder particles produced during the manufacturing process and each having a particle size of about 0.2 to 2 μm are attached to the surface of the carrier. When the silica particles are added to the developer material containing the carrier to which the very fine powder particles are attached, the very fine powder particles attached to the surface of the carrier are removed from the carrier surfaces during stirring of the developer material in the developing unit. The removed powder particles are adhered to silica particles (particle size: 0.2 to 0.8 μm). When a material obtained by bonding the very fine powder carrier and the silica particles is attached to the surface of the photosensitive drum, the surface free energy of the interposing material becomes large since the surface free energy of the very fine powder carrier is higher than that of the silica particles. Therefore, an effect for enhancing removal of the toner particles from the surface of the drum surface is degraded. Therefore, when an amount of very fine powder carrier attached to the surface of the photosensitive drum is gradually increased with an increase in the number of printing cycles, the toner tends not to be removed from the surface of the photosensitive drum, and the transfer efficiency is degraded. In addition, when the very fine powder carrier is attached to the surface of the photosensitive drum, it absorbs moisture to decrease the electrical resistance of the surface of the photosensitive drum, thereby causing image blurring.

A developer material d having the following composition and prepared by mixing a carrier which was freed from the very fine powder component which caused degradation of the transfer efficiency was used to perform an image formation experiment, and the following result was obtained.

EXPERIMENT 5

Components of Developer Material d

| | |
|---|---|
| Ferrite carrier (Cu—Zn—Mg; average particle size: 50–60 μm; very fine powder of particle size of 0.2–0.8 μm is eliminated) | 225 parts by weight |

-continued

| | |
|---|---|
| N type toner (average particle size: 12.5 μm) | 25 parts by weight |
| hydrophobic silica (H-2000) (average particle size: 0.2–0.8 μm) | 0.25 parts by weight (1.0 wt % with respect to toner) |

By using the above developer material d, image formation was performed following the same procedures as in Experiment 1.

(Results)

Figure 3:
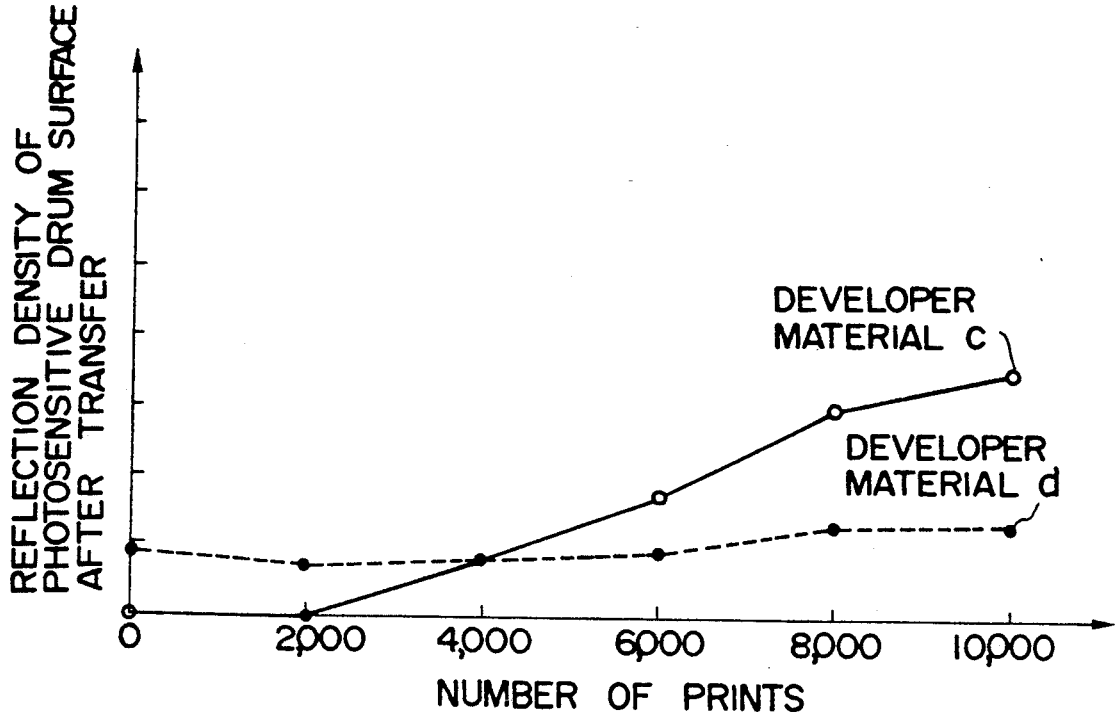
FIG. 3 is a graph showing a relationship between the number of prints and the reflection density of the surface of a photosensitive drum after transferring, when image formation is performed using a developer material containing a carrier with or without a very fine powder.

The experimental result is shown in FIG. 3. The number of prints is plotted along the abscissa, and the reflection density of the photosensitive drum surface after transferring which represents transfer efficiency is plotted along the ordinate. The reflection density of the surface of the photosensitive drum and the transfer efficiency have a negative correlation given such that the reflection density is increased when an amount of nontransferred toner is increased. Therefore, when a characteristic curve ascends, it indicates that the transfer efficiency is degraded with an increase in number of prints. According to the graph in FIG. 3, when the developer material c of Experiment 4 is used, the transfer efficiency is degraded when the number of prints reaches 4,000. However, when the developer material d is used, the transfer efficiency undergoes almost no degradation until the number of prints reaches 10,000.

In the result of observation of print images, as for the developer material c, an afterimage is formed and image blurring at a high humidity occurs when the number of prints exceeds 4,000. As for the developer material d, an afterimage is not formed and image blurring at a high humidity does not occur until the number of prints reaches 10,000.

Two types of developer materials were prepared by using the carrier without containing the very fine powder as described above and changing the content of the hydrophobic silica particles with respect to the toner between 0.5 wt% and 2.0 wt%, and an experiment similar to that described above was performed. As a result, though the resultant developer materials were inferior to the developer material d, the afterimage phenomenon and image blurring at a high humidity did not occur until the number of prints reached about 8,000.

According to the above experimental results, the developer material obtained by mixing the toner with the carrier freed from the very fine powder and by adding 0.5 to 2.0 wt% of hydrophobic silica particles with respect to the toner was found to be very effective to maintain high transfer efficiency and prevent image blurring at a high humidity. It was found that good image quality could be stably maintained for a long period of time by the electrophotographic process without cleaning regardless of changes in environmental conditions.

A second method of reducing the afterimage and image blurring is to mix a magnetic powder in a resin and to granulate the resultant mixture to prepare particles as a carrier, or to mix the particles in a usual carrier.

Image formation experiments were conducted using: the developer material c containing a usual carrier; a developer material e prepared by using a magnetic material/resin mixed carrier prepared such that a very fine magnetic power component causing degradation of the transfer efficiency was eliminated, the magnetic material was dispersed and mixed in the resin, and the mixture was then granulated; a developer material f prepared by using a carrier obtained by mixing the usual carrier and the magnetic material/resin mixed carrier at a ratio of 4 : 6; and a developer material g prepared by using a carrier obtained by changing the above mixing ratio to 7 : 3 . The following results were obtained.

EXPERIMENT 6

Components of Developer Material e

| | |
|---|---|
| Magnetic material/resin mixed carrier | |
| Styrene-acrylic resin: | 33 parts by weight |
| Magnetite particle: | 67 parts by weight |
| | 225 parts by weight |
| N type toner (average particle size: 12.5 μm) | 25 parts by weight |
| Hydrophobic silica (H-2000) (average particle size: 0.2-0.8 μm) | 0.25 parts by weight (1.0 wt % with respect to toner) |

Components of Developer Material f

| | |
|---|---|
| Magnetic material/resin mixed carrier | 135 parts by weight |
| Ferrite Carrier (Cu—Zn—Mg; particle size: 50-60 μm) | 90 parts by weight average |
| N type toner (average particle size: 12.5 μm) | 25 parts by weight |
| Hydrophobic silica (H-2000) (average particle size: 0.2-0.8 μm) | 0.25 parts by weight (1.0 wt % with respect to toner) |

Component of Developer Material g

| | |
|---|---|
| Magnetic material/resin mixed carrier | 68 parts by weight |
| Ferrite Carrier (Cu—Zn—Mg; particle size: 50-60 μm) | 167 parts by weight average |
| N type toner (average particle size: 12.5 μm) | 25 parts by weight |
| Hydrophobic silica (H-2000) (average particle size: 0.2-0.8 μm) | 0.25 parts by weight (1.0 wt % with respect to toner) |

Image formation was performed following the same procedures as in Experiment 1 except that the two-component type developer material c e, f, and g were used.

(Results)

Figure 4:
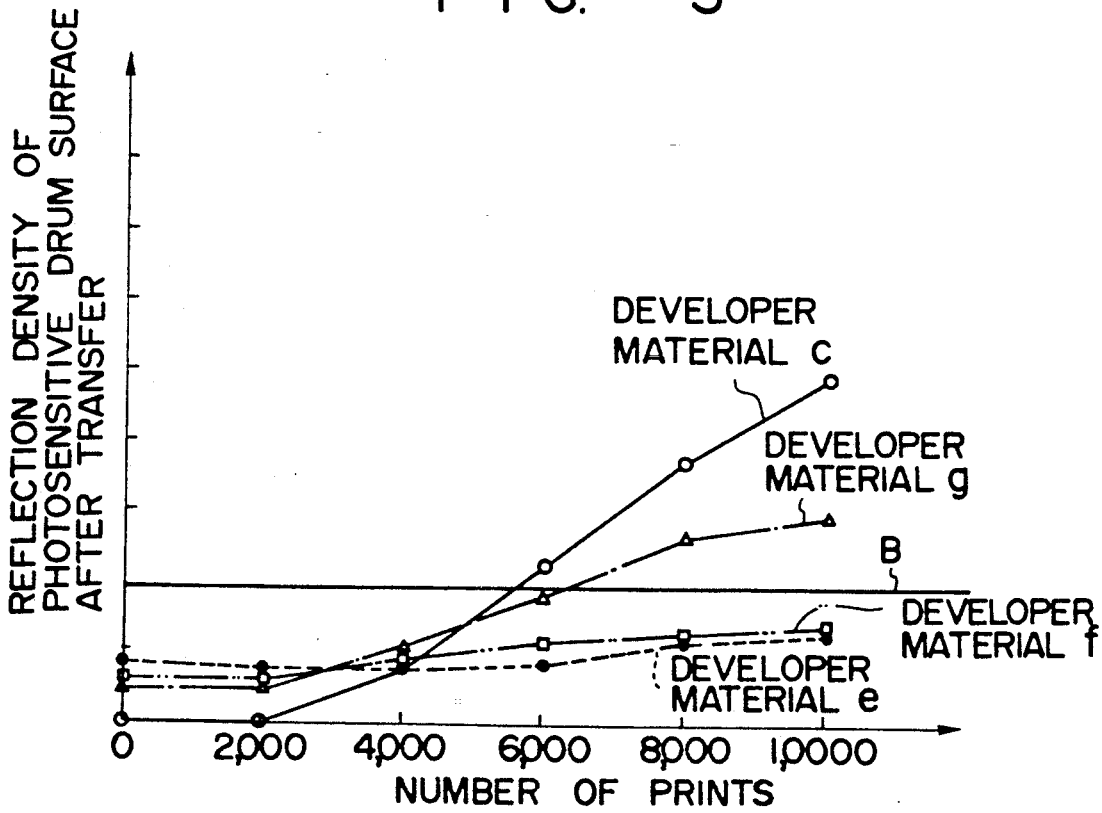
FIG. 4 is a graph showing a relationship between the number of prints and the reflection density of the surface of the photosensitive drum after transferring, when image formation is performed using a developer material containing as a carrier particles obtained by dispersing a magnetic powder in a resin material or a developer material containing such carrier particles and a normal carrier, as compared with a developer material containing the normal carrier.

The experimental results are shown in FIG. 4. The number of prints is plotted along the abscissa, and the reflection density of the photosensitive drum surface after transferring which represents transfer efficiency is plotted along the ordinate, as in FIG. 3. Again, when a characteristic curve ascends, the transfer efficiency is degraded with an increase in number of prints. A line B in the graph represents an allowable limit line of the reflection density and corresponds to the lower limit value of transfer efficiency required to obtain satisfactory image quality in the image formation process without cleaning.

As is apparent from the graph, when the developer material c is used, the transfer efficiency is gradually decreased when the number of prints exceeds about 2,000, and the characteristic curve exceeds the allowable limit line B of the reflection density when the number of print is about 5,800. When the transfer efficiency degradation exceeds the allowable limit, a printing error such as an afterimage caused by a residual toner occurs in the image. Image blurring at a high humidity occurs when the number of prints exceeds about 4,000. When the number of prints reaches 10,000, the image cannot be identified at all.

When the developer material g is used, degradation (i.e., an increase in reflection density) of transfer efficiency is moderate as compared with the developer material c but has the same tendency as that of the developer material c. The transfer efficiency exceeds the allowable limit line B and an afterimage is formed when the number of prints is about 6,500. Image blurring at a high humidity occurred when the number of prints is about 5,000. The image could not be identified at all when the number of prints reaches about 10,000.

When the developer materials e and f are used, the reflection density is not decreased below the allowable limit line B and an afterimage is not formed until the number of prints reaches 10,000. In addition, image blurring at a high humidity does not occur. Degradation of transfer efficiency of the developer material e is slightly smaller than that of the developer material f.

In order to confirm the above result, two types of developer materials were prepared as in the developer material e except that the contents of the hydrophobic silica particles were set to be 0.5 wt% as the lower limit which did not adversely affect image quality and wt% as the upper limit. In this case, transfer efficiency of these developer materials was degraded more than that of the developer material e. However, the afterimage phenomenon and image blurring did not occur until the number of prints reached about 8,500.

According to the above experimental results, when the image formation process without cleaning was performed using a developer material prepared such that the toner material was mixed with the carrier material containing the magnetic material/resin carrier mixture and 0.5 to 2.0 wt% of the hydrophobic silica particles were mixed in the toner material, the required high transfer efficiency could be stably maintained until the number of prints was 5,000 or more. At the same time, image blurring at a high humidity could be perfectly prevented, and good image quality could be stably obtained for a long period of time regardless of changes in environmental conditions.

The above experimental results are analyzed as follows.

As described above, the material which causes two defects, i.e., degradation of transfer efficiency and image blurring at a high humidity is a very fine powder component contained in the carrier. The very fine powder component contained in the magnetic material/resin mixed carrier is not easily bonded to hydrophobic silica particles. If bonded, the very fine powder component is transferred to the transfer sheet since it has a high electrical resistance and becomes unnoticeable background contamination and discharged outside the copying machine together with the transfer sheet. That is, the very fine powder of the magnetic material/resin mixed carrier is not a material causing the above two defects even if it is not eliminated by a classification treatment.

The developer material e containing the magnetic material/resin mixed carrier without using the usual carrier does not cause the above two defects. However, the developer materials f and g containing both the magnetic material/resin mixed carrier and the usual carrier are subjected to degradation caused by the very fine powder component in the usual carrier. In this case, degradation by the developer material f having a smaller content of the usual carrier is as small as that of the developer material e. However, the developer material g having a higher content of the usual carrier undergoes a greater influence of the very fine powder component of the usual carrier, and therefore the above two defects tend to be caused.

It has been further found that image contrast at a low temperature and a low humidity is degraded when a developer material containing hydrophobic silica particles is used, apart from the above-noted afterimage phenomenon and image blurring.

According to the experiments of the present inventors, the image formation process without cleaning was performed by the above liquid crystal printer according to the reversal developing method using a developer material, to which 0.5 to 1.0 wt%, with respect to the toner, (this range did not adversely affect image formation) of hydrophopic silica particles having a degree of hydrophobicity of 80% (Wacker Chemicals East Asia Corp: H-2000) was added, at room temperature and a normal humidity. No image trouble such as the afterimage phenomenon and degradation of contrast occurred.

Figure 5:
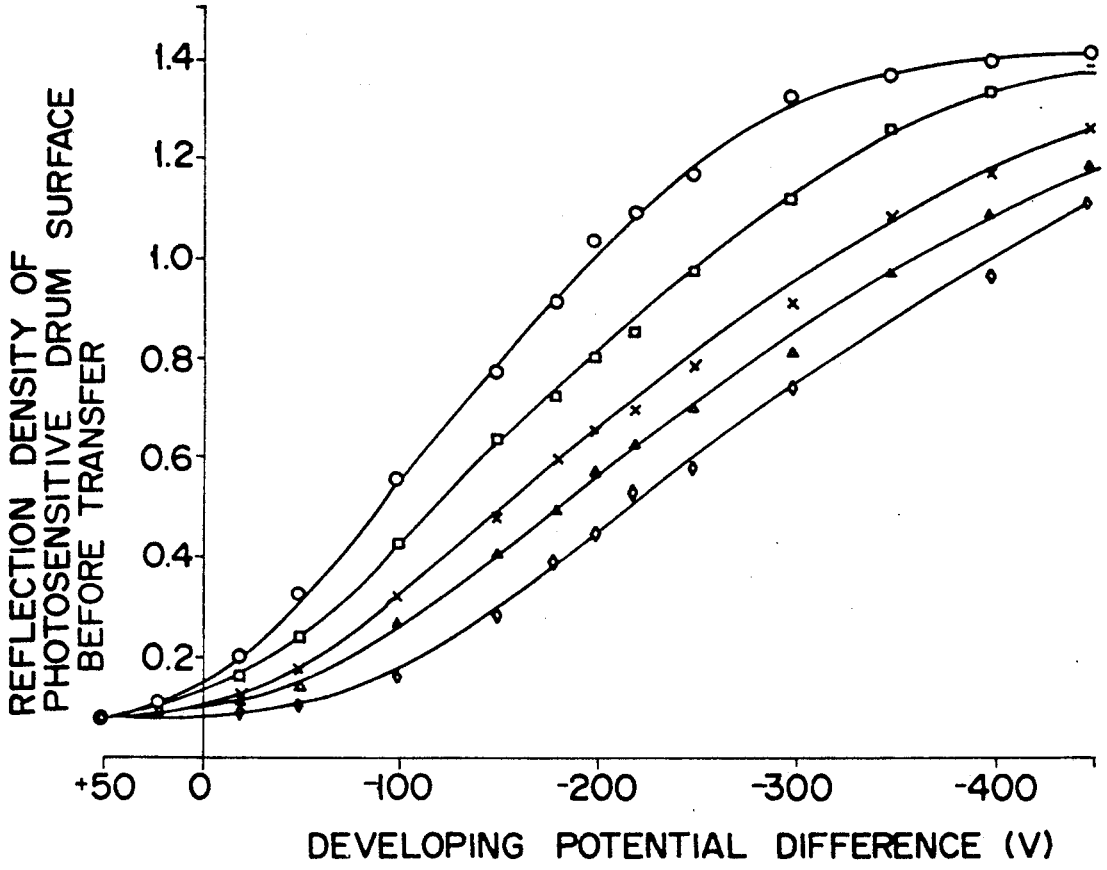
FIG. 5 is a graph showing a relationship between the developing potential difference and the reflection density of the surface of the photosensitive drum before transferring, when image formation is performed using developer material having different silica contents.

However, the contents of the hydrophobic silica particles were changed to 0, 0.1, 0.3, 0.5, and 1.0 wt% (with respect to the weight of the toner) at a low temperature of 10° C. and a low humidity of 10%, and an image formation experiment similar to the above experiment was performed. Results shown in FIG. 5 were obtained. A graph shown in FIG. 5 exhibits a change in developing density as a change in reflection density of the photosensitive drum surface before transferring (measured by a Macbeth reflection densitmeter) versus a developing potential difference (i.e., (developing bias potential)−(latent developing potential)). High contrast can be easily obtained as the gradient of the curve becomes large. When the content of the hydrophobic silica particles is increased, the image contrast is degraded. As a result, the cause of the degration of image contract is assumed to be excessive addition of the hydrophobic silica particles.

Conventionally, 0.05 to 0.5 wt% of silica particles are added to the toner as the fluidity accelerator of the developer material. When 0.5 wt% or more of the silica particles are added to the toner, the transfer efficiency is increased to almost 100%. However, fluidity of the developer material becomes excessive. For this reason, friction between the toner and the carrier is excessively increased to charge the toner to an undesirable level. The silica particles themselves are subjected to frequent friction with the toner and the carrier, and the charges of the silica particles are increased. These silica particles are attracted to the surface of the toner to form a composition. As a result, the charge of the toner composition as a whole is further increased. At a low temperature and a low humidity, natural leakage of the charge is small, and the charge is maintained for a long period of time. As a result, a charge having a level higher than the required level is stably retained in the toner composition. Thus, a Coulomb force of the toner composition and the carrier becomes higher than the developing electric force, thereby degrading image contrast.

Under this condition, the excessive charge of the toner composition must be eliminated by some means. According to the present inventors, leakage of the excessive charge through the carrier was taken into consideration. When the charge of the toner composition is allowed to leak through the carrier, smaller the volume resistivity of the carrier, the better the results. When the volume resistivity of the carrier is decreased, the electrode effect of the carrier is improved to increase the developing electric force. In this respect, desired image contract can be maintained.

EXPERIMENT 7

(Method)

Composition of Developer Material

| | |
|---|---|
| Ferrite carrier (Cu—Zn—Mg; particle size: 50–60 μm) | 225 parts by weight |
| N type toner (particle size: 12.5 μm; styrene-acrylic copolymer) | 25 parts by weight |
| Hydrophobic silica (H-2000) (average particle size: 0.2–0.8 μm) | 0.25 parts by weight (1.0 wt % with respect to toner) |

Figure 6:
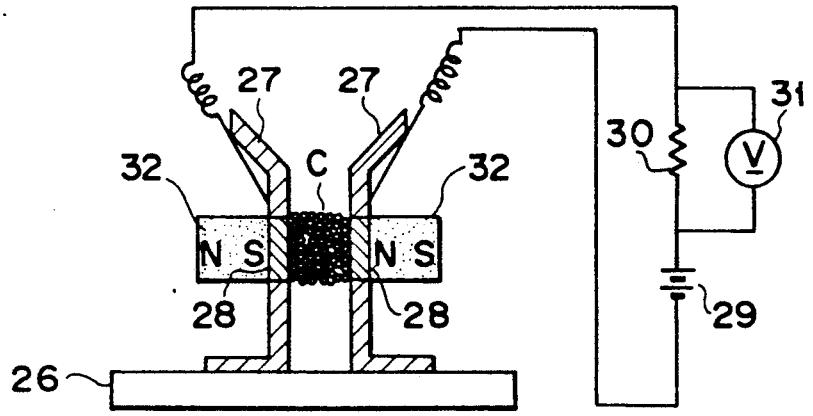
FIG. 6 is a schematic view showing an apparatus for measuring a volume resistivity of a carrier used in a developer material.

Image formation by the printer shown in FIG. 1 was performed by using five developer materials containing carriers having different volume resistivities while the developing bias potential was changed. Densities of the resultant print images were measured by the Macbeth reflection densitmeter. Potentials except for the developing bias potential were:

Initial charge potential Vs ... −600 V
Background potential VH ... −450 V
Exposed portion potential VL ... −20 V Measurements of the volume resistivities of the carriers were performed using an apparatus shown in FIG. 6. A pair of parallel guide plates 27 extend upward on a base 26 to be spaced apart from each other. Electrodes 28 made of a nonmagnetic conductor are respectively embedded at the centers of the guide plates 27. The electrodes 28 are connected to terminals of a DC power source 29. A reference resistor 30 is arranged in this voltage applying circuit. A voltmeter 31 is connected across the reference resistor 30.

A volume resistivity of a carrier is measured as follows. A carrier C to be measured is placed in a space between the guide plates 27, and magnets 32 are brought into slidable contact with the outer surfaces of the guide plates 27, respectively. The carrier C is then placed between the electrodes 28. Under this condition, a predetermined voltage is applied to the electrodes 28. A voltage across the reference resistor 30 is measured 10 seconds after the start of voltage application. The measured voltage is converted into a volume resistivity of the carrier.

In the above arrangement,
Interelectrode distance ... 8 mm
Electrode diameter ... 8 mm
Electrode thickness ... 1.5 mm
Magnetic force of magnet ... 1,000 G
Applied voltage ... 1,000 V
Carrier weight ... 500 mg The measurement was performed in a room at 25° C. and a humidity of 60%.

(Results)

Figure 7:
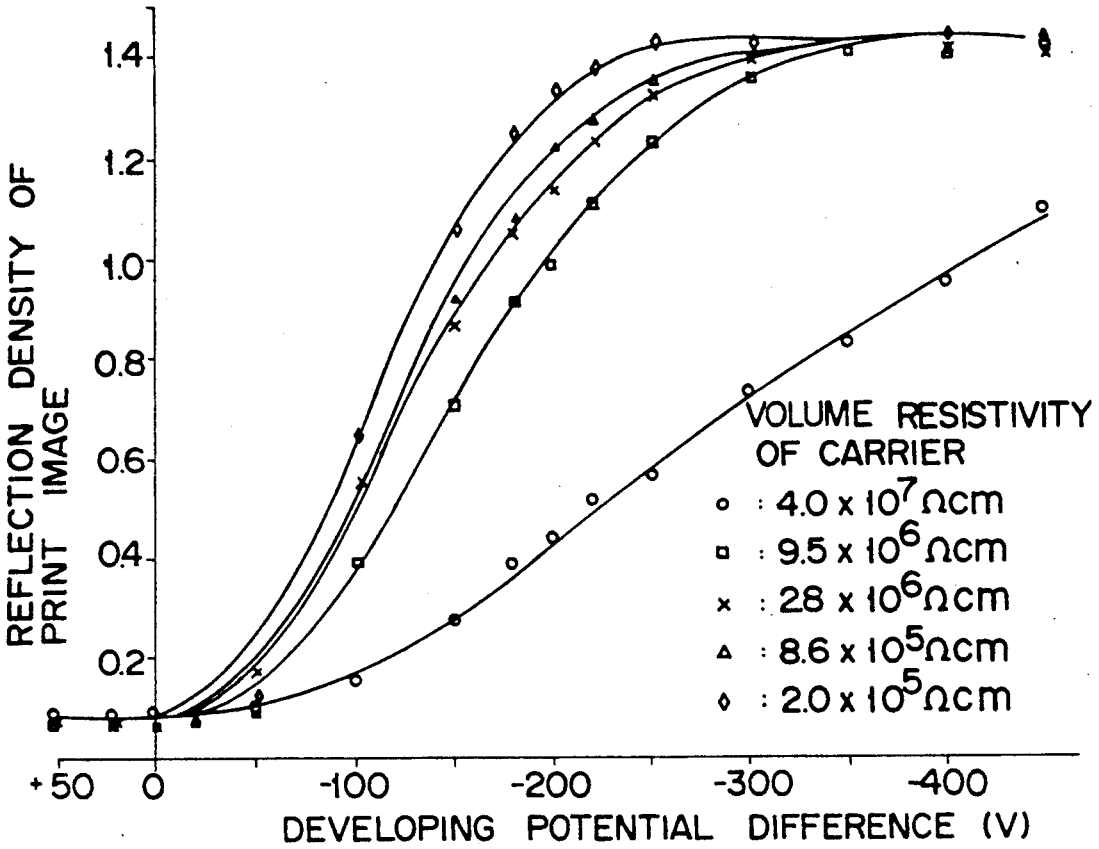
FIG. 7 is a graph showing a relationship between the developing potential difference and the reflection density of a print image, when image formation is performed using developer material containing carriers having different volume resistivities.

FIG. 7 shows the experimental results. The developing potential difference is plotted along the abscissa, and the reflection density of the print image is plotted along the ordinate. As apparent from the results, the gradient of the developing characteristic curve is increased when the volume resistivity of the carrier is decreased. The gradient of the curve obtained by using the developer material containing the carrier having a maximum volume resistivity of $4.0\times10^7$ Ω·cm is the smallest.

Figure 8:
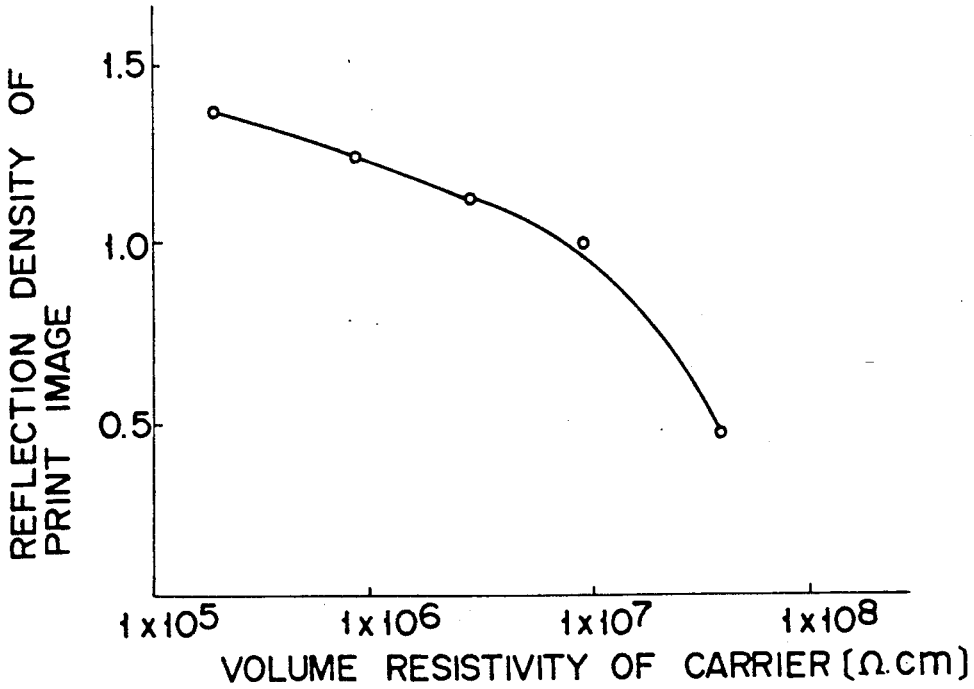
FIG. 8 is a graph showing a relationship between the volume resistivity of the carrier used in the developer material and the reflection density of a print image.

In the electrophotographic image formation process, in order to obtain necessary image contrast by a usual operation, when the absolute value of the developing potential difference is 200 V, an image having a reflection density of about 1.0 must be obtained. FIG. 8 shows a relationship between the volume resistivity of the carrier and the reflection density of a print image obtained when the developing potential difference is −200 V. When a volume resistivity of a carrier is $1\times10^7$ Ω·cm or less, an image having a reflection density of 1.0 or more is obtained. When the volume resistivity of the carrier is more than $1\times10^7$ Ω·cm, the image density becomes 1.0 or less, and a rate of decrease (with respect to an increase in volume resistivity of the carrier) is abruptly increased.

The same experiment as described above was performed by changing the content of the silica particles of the developer material with respect to the toner particles in the developer material to 0.5 wt%. Similar results were obtained.

As can be apparent from the above experimental results, a developer material containing a toner mixed with a carrier having a resistivity of $1\times10^7$ Ω·cm or less and preferably $1\times10^6$ Ω·cm or less together with 0.5 wt% or more of the hydrophobic silica particles with respect to the toner is very effective to maintain high transfer efficiency and prevent image contrast from lowering at a low temperature and a low humidity. When this developer material is used, good image quality can be stably maintained for a long period of time while the afterimage phenomenon is not formed and high contrast is maintained by the electrophotographic process without cleaning.

A second method of preventing degradation of the transfer efficiency and the image contrast at a low temperature and a low contrast even if hydrophobic silica particles are used is to mix a second additive (a metal oxide or acrylic polymer) having a rate of charge lower (on the order of 100 to 200) than that of silica. The second additive should not adversely affect image quality. The present inventors have performed the following experiment using aluminum oxide, titanium dioxide, and an acrylic polymer which are used as additives for the electrophotographic image formation process developer material and which have a rate of frictional charge (i.e., a rate of charge with respect to the degree of friction) lower than that of the silica particles as materials suitable as the second additive.

EXPERIMENT 8

Components of Developer Material h

| | |
|---|---|
| Ferrite carrier (Cu—Zn—Mg; average particle size: 50–60 μm) | 225 parts by weight |
| N type toner (average particle size: 12.5 μm) | 25 parts by weight |
| Hydrophobic silica (H-2000) (average particle size: 0.2–0.8 μm) | 0.25 parts by weight (1.0 wt % with respect to toner) |
| Aluminum oxide (average particle size: 2 μm) | 0.375 parts by weight (1.5 wt % with respect to toner) |

Components of Developer Material i

| | |
|---|---|
| Ferrite carrier (Cu—Zn—Mg; average particle size: 50–60 μm) | 225 parts by weight |
| N type toner (average particle size: 12.5 μm) | 25 parts by weight |
| Hydrophobic silica (H-2000) (average particle size: 0.2–0.8 μm) | 0.25 parts by weight (1.0 wt % with respect to toner) |
| Titanium dioxide (average particle size: 5 μm) | 0.225 parts by weight (0.9 wt % with respect to toner) |

Components of Developer Material j

| | |
|---|---|
| Ferrite carrier (Cu—Zn—Mg; (average particle size: 50–60 μm; very fine powder component is eliminated) | 225 parts by weight |
| N type toner (average particle size: 12.5 μm) | 25 parts by weight |
| Hydrophobic silica (H-2000) particle (average particle size: 0.2–0.8 μm) | 0.25 parts by weight (1.0 wt % with respect to toner) |
| Polymethylmethacrylate fine powder (average particle size: 0.4 μm) | 0.375 parts by weight (1.5 wt % with respect to toner) |

Components of Comparative Developer Material k

| | |
|---|---|
| Ferrite carrier (Cu—Zn—Mg; average particle size: 50–60 μm) | 225 parts by weight |
| N type toner (average particle size: 12.5 μm) | 25 parts by weight |
| Hydrophobic silica (H-2000) (average particle size: 0.2 to 0.8 μm) | 0.25 parts by weight (1.0 wt % with respect to toner) |

Components of Comparative Developer Material l

| | |
|---|---|
| Ferrite carrier (Cu—Zn—Mg; (average particle size: 50–60 μm) | 225 parts by weight |
| N type toner (average particle size: 12.5 μm) | 25 parts by weight |
| Hydrophobic silica (H-2000) (average particle size: 0.2–0.8 μm) | 0.025 parts by weight (0.1 wt % with respect to toner) |

Image formation was performed by the printer of FIG. 1 according to the reversal developing method using the above four types of two-component type developer materials. The respective potentials of the printer were the same as those in Experiment 1.

(Results)

The experimental results are is shown in Table 2. The image density values in Table 2 are those of print images obtained at a temperature of 5° C. and a humidity of 30%, as measured by the Macbeth reflection densitmeter. The transfer efficiency is given as a voltage value obtained when light reflected by the residual toner on the photosensitive drum surface upon radiation of light after the transfer step is measured by a phototransistor. In this case, a voltage in the total absence of the residual toner is set to be 10 V.

TABLE 2

| Developer Material | Image Density at Low Temperature, Low Humidity | | Transfer Property (100 prints) | | Transfer Property (5000 prints) | | Total Evaluation |
|---|---|---|---|---|---|---|---|
| | Density | Image Quality | Amount of Light (V) | Transfer Efficiency | Amount of Light (V) | Transfer Efficiency | |
| h | 1.05 | ○ | 9.75 | ○ | 9.70 | ○ | ○ |
| i | 1.10 | ○ | 9.25 | ○ | 9.25 | ○ | ○ |
| j | 1.10 | ○ | 9.25 | ○ | 9.25 | ○ | ○ |
| k | 0.55 | Δ | 9.75 | ○ | 8.80 | Δ | Δ |
| l | 1.0 | ○ | 8.50 | x | 8.47 | x | x |

○: good Δ: slightly poor x: poor

As seen from Table 2, when the developer materials h and j added with the second additives were used, high transfer efficiency was maintained until the number of prints reached 5,000. Also, good image quality was stably obtained without decreasing the image density. However, when the comparative developer material k having a large content (1.0 wt% with respect to the toner) of silica particles without adding the second additive was used, transfer efficiency was good in the early stage. However, transfer efficiency began to degrade when the number of prints reached 5,000. Further, this developer material poses a problem in image quality since the resultant image has a low density at a low humidity. When the comparative developer material l having a low content (0.1 wt% with respect to the toner) of the silica particles without adding the second additive was used, the image density was not decreased. However, the transfer efficiency was degraded in the initial period and when the number of prints reached 5,000. This developer material cannot be applied to the process without cleaning When a developer material similar to developer material j except that the carrier was freed of a fine powder, each particle of which had a size of 2 μm or less, was used, high transfer efficiency was maintained for a long period of time and a decrease in image density at a low temperature and low humidity was not found until the number of prints reached 10,000, obtaining good image quality.

An effect of addition of the second additive, i.e., an effect for maintaining high transfer efficiency without decreasing the image density according to the experiment of the present invention has been confirmed.

In the developer material containing the second additive, the contents of the silica particles as the first additive and the second additive were changed to determine optimal ranges of the contents of the additives. According to these experiments, it has been found that high transfer efficiency can be effectively maintained without lowering the image density if the first and second additive contents fall within the following ranges with respect to the toner weight:

Silica particles ... 0.7 to 1.5 wt%

Second additive ... 0.3 to 2.0 wt%

A material having a lower electrical volume resistivity than that of the toner was confirmed to be preferable as the second additive according to an experiment. A preferred volumes resistivity of the second additive is $10^{13}$ Ω·cm or less.

According to the experimental results described above, when 0.7 to 1.5 wt% of silica particles as the first additive having a high degree of hydrophobicity are added to the toner and 0.3 to 2.0 wt% of a material as a second additive having a lower rate of charge than that of the silica particles and a lower volume resistivity than that of the toner are added to the toner to prepare a developer material, high transfer efficiency is maintained for a long period of time and a necessary image density is always assured regardless of changes in environmental conditions. Therefore, when this developer material is used in the electrophotographic image formation process without cleaning, good image quality can be stably maintained for a long period of time without causing the afterimage phenomenon.

In the above embodiments, a developer material containing hydrophobic silica is used to improve transfer efficiency. However, it has been found that the transfer efficiency can be further improved when a photosensitive drum having a coating layer containing dispersed hydrophobic silica particles on its surface is used in combination with the above developer material. This embodiment will be described below with reference to FIG. 9.

Figure 9:
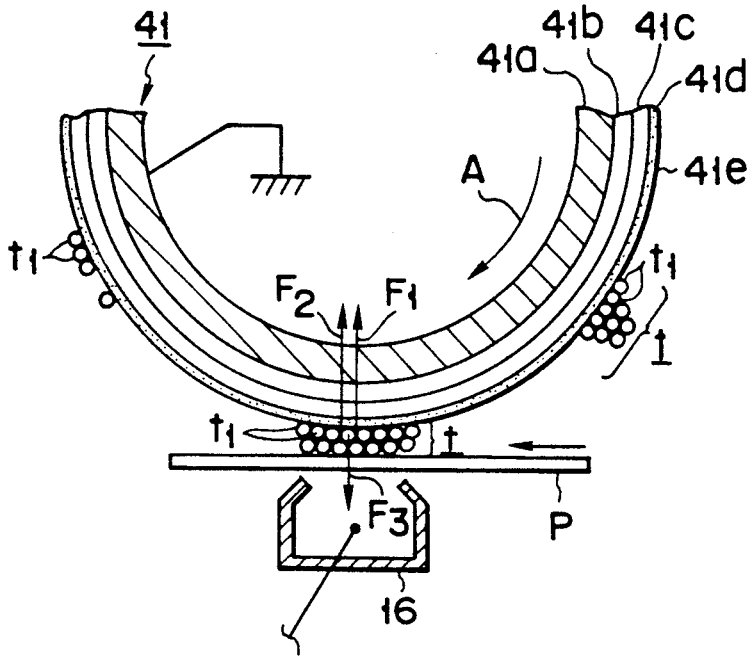
FIG. 9 is a schematic sectional view for explaining the step of transferring a toner image when a photosensitive drum having thereon a coating layer containing hydrophobic silica particles dispersed therein is used.

As shown in FIG. 9, a carrier generation layer 41*b* and a carrier transfer layer 41*c* are sequentially formed on a cylindrical conductive substrate 41*a*, and an overcoat layer 41*d* of material obtained by dispersing particles having a low surface free energy into a transparent binder resin is formed on the carrier transfer layer 41*c*, thereby constituting an electrophotographic photosensitivie drum 41. In this case, by exposing the dispersed particles to the surface of a photosensitive drum surface 41*e*, a toner layer t is attracted to the surface of the photosensitive drum through the particles having a low surface free energy. Therefore, the Van der Waals force between the photosensitive drum 41 and the toner layer t can be weakened. The thickness of the overcoat layer 41*d* is preferably 1 μm or less so as not to adversely affect image formation.

The present inventors made extensive studies wherein silica ($SiO_2$) particles conventionally added to improve fluidity of the developer material used in the electrophotographic image formation process and having a low surface free energy were examined as particles suitably dispersed and mixed in the overcoat layer 41*d*. The experimental result will be described below.

EXPERIMENT 9

(Method)

An overcoat layer obtained by dispersing and mixing hydrophobic silica particles (H-2000 available from Hoechst Corp.) in an acrylic resin (Mowital B30H available from Hoechst Corp.) was formed on an organic photosensitive conductor (OPC) drum obtained by forming a carrier generation layer and a carrier transfer layer on a cylindrical conductive substrate, thereby preparing an electrophotographic photosensitive drum.

A two-component type magnetic developer material having the following composition was prepared:

| | |
|---|---|
| Ferrite carrier (Cu—Zn—Mg: average particle size: 50–60 μm) | 225 parts by weight |
| N type toner (average particle size: 12.5 μm) | 25 parts by weight |

Image formation was performed using this developer material and the photosensitive drum by the printer shown in FIG. 1.

The transfer property was evaluated such that a residue on the photosensitive drum surface 41*e* immediately after the transfer process was removed by a cellophane adhesive tape and a reflection density of the residue was measured by the Macbeth densitmeter. The potentials in the printer were set as in Experiment 1.

(Results)

A reflection density of residue after the transfer operation was 0.22. The reflection density of the cellophane adhesive tape was 0.12.

EXPERIMENT 10

Printing was performed following the same procedures as in Experiment 9 except that a conventional OPC photo-sensitive drum without forming an overcoat layer was used in place of the electrophotographic photosensitive drum used in Experiment 9.

A reflection density of a residue after the transfer operation was 0.38.

EXPERIMENT 11

Printing was performed following the same procedures as in Experiment 9 except that a photosensitive drum having an overcoat layer consisting of an acrylic resin prepared without dispersing or mixing hydrophobic silica particles was used in place of the electrophotographic photosensitive drum used in Experiment 9.

A reflection density of a residue after the transfer operation was 0.40.

EXPERIMENT 12

A developer material was prepared by adding 0.075 parts by weight (0.3 wt% with respect to the toner) of the same hydrophobic silica particles as those dispersed and mixed in the overcoat layer of the photosensitive drum to the developer material used in Experiment 9.

A reflection density of a residue after the transfer operation was 0.16.

EXPERIMENT 13

Printing was performed to check the transfer property following the same procedures as in Experiment 9 except that a conventional OPC photosensitive drum was used as in Experiment 10 and a developer material as in Experiment 12, i.e., a two-component type developer material added with 0.075 parts by weight (i.e., 0.3 wt% with respect to the toner) of hydrophobic silica particles, was used.

A reflection density of a residue after the transfer operation was 0.29.

The above experimental results are summarized in Table 3.

TABLE 3

| | Photosensitive Drum | Developer Material | Reflection Density of Residue |
|---|---|---|---|
| Experiment 9 | Silica Overcoat | Usual Two Component Type | 0.22 |
| Experiment 10 | Usual OPC | Usual Two Component Type | 0.38 |
| Experiment 11 | Acrylic Overcoat | Usual Two Component Type | 0.40 |
| Experiment 12 | Silica Overcoat | Added with Silica | 0.16 |
| Experiment 13 | Usual OPC | Added with Silica | 0.29 |

Note: Reflection density of cellophane adhesive tape is 0.12

As can be apparent from Table 3, the reflection density, 0.16 of the residue obtained in Experiment 12 is almost 100% transfer efficiency since the reflection density of the cellophane adhesive tape is 0.12. The reflection density of 0.22 in Experiment 9 is close to 100% transfer efficiency.

According to the above experimental results, by using the photosensitive drum having an overcoat layer obtained by dispersing and mixing the hydrophobic silica particles, the transfer efficiency of the toner could be greatly improved, and a good image free from image quality defects such as an afterimage could be obtained in the image forming process without cleaning. In this case, when both the photosensitive drum having the overcoat layer thereon and the developer material added with an appropriate amount of hydrophobic silica particles were used, a good image without the afterimage phenomenon could be stably and appropriately obtained in the image formation process without cleaning.

Light-Transmitting Fine Powder

A light-transmitting fine powder may be used in place of the hydrophobic silica particles as the transfer accelerator.

A resin powder which is charged to the same polarity as that of a toner upon friction with a carrier is preferable as such a fine powder. A light-transmitting resin powder can be easily obtained by emulsion polymerization or the like, and a desired uniform particle size can be obtained. Frictional charge characteristics of the resin powder can be freely changed and can easily cope with frictional charge characteristics of the toner. In addition, no problem is posed in fixing properties when the same kind of resin as that constituting a toner or a resin similar thereto is used. The present inventors examined a polymethylmethacrylate light-transmitting fine powder selected from acrylic resins contained in conventional toners as a binder.

Studies and experiments for selecting a polymethylmethacrylate fine powder suitable in the method of the present invention will be described below. An effect obtained by adding a polymethylmethacrylate fine powder varies depending on particle sizes, frictional charge characteristics, and contents. The present inventors made experiments by taking the above three factors into consideration.

EXPERIMENT 14

(Method)

Image formation by the printer of FIG. 1 was performed using a two-component type developer material obtained by mixing the following components in a ball mill:

| | |
|---|---|
| Ferrite carrier (Cu—Zn—Mg, average particle size: 50-60 μm) | 225 parts by weight |
| N type toner (average particle size: 12.5 μm) | 25 parts by weight |

A printing operation was interrupted and a residue on the photosensitive drum 11 immediately after the transfer operation was peeled by a cellophane adhesive tape, and a reflection density of the residue was measured by the Macbeth densitmeter. The printing operation was restarted, and formation of an afterimage on the resultant image was visually examined. Other experimental conditions were the same as those in Experiment 1.

(Results)

A reflection density of the residue after the transfer operation was 0.27.

Visual Examination of Image

The density of an image portion corresponding to a surface portion of the photosensitive drum 11 where the residue was present was lowered.

EXPERIMENT 15

(Method)

An experiment was performed following the same procedures as in Experiment 14 except that a developer material was prepared by mixing the following components by a Henschel mixer in advance:

| | |
|---|---|
| N type toner (average particle size: 12.5 μm) | 25 parts by weight |
| Polymethylmethacrylate fine powder (prepared by emulsion polymerization) | 0.5 parts by weight (2 wt % with respect to toner) |
| Charging polarity: negative | |
| Average molecular weight: 400,000 | |
| Average particle size: 0.4 μm | |

and the resultant mixture was mixed with:

| | |
|---|---|
| Ferrite carrier (Cu—Zn—Mg; average particle size: 50-60 μm) | 225 parts by weight |

(Results)

A reflection density of a residue after the transfer operation was 0.12.

This reflection density was the same as that of the cellophane adhesive tape itself, and no residue on the cellophane adhesive tape was detected. However, when the surface of the photosensitive drum after the transfer operation was observed, presence of a white powder corresponding to a printing pattern was confirmed. In this case, when the cellophane adhesive tape was adhered to the white powder and was peeled off for visual observation, no white powder was found. In general, when light is irregularly reflected by the surface of the light-transmitting particles, it looks whitish. When irregular reflection is prevented by the cellophane adhesive tape, it looks transparent. Therefore, the residue on the surface of the photosensitive drum can be judged as the polymethylmethacrylate fine powder.

Visual Examination of Image

Neither the afterimage phenomenon nor degradation of the density were found, and good image quality was obtained.

EXPERIMENT 16

An experiment was performed following the same procedures as in Experiment 15 except that a fine powder which was surface-treated to the positive polarity was used in place of the polymethylmethacrylate fine powder used in Experiment 15, and a developer material was prepared by using the fine powder having the positive polarity.

(Results)

A result as in Experiment 14 was obtained. When the surface of the photosensitive drum was observed, a large amount of fine powder particles were attached to the background portion. However, almost no fine powder particles were observed in the image portion.

EXPERIMENT 17

(Method)

An experiment was performed following the same procedures as in Experiment 15 except that a polymethylmethacrylate fine powder having a particle size of 0.2 μm was used in place of the polymethylmethacrylate fine powder in the developer material used in Experiment 15, and an amount of the fine powder with respect to the toner was changed.

(Results)

A good result as in Experiment 15 was obtained when the content of the polymethylmethacrylate fine powder was 0.25 parts by weight (i.e., 1 wt% with respect to the toner).

EXPERIMENT 18

(Method)

An experiment was performed following the same procedures as in Experiment 15 except that a polymethylmethacrylate fine powder having a particle size of 2 μm was used in place of the polymethylmethacrylate fine powder in the developer material used in Experiment 15, and an amount of the fine powder with respect to the toner was changed.

(Results)

Formation of the afterimage was not eliminated even when the content of the polymethylmethacrylate fine powder was increased to 2.5 parts by weight (i.e., 10 wt% with respect to the toner).

EXPERIMENT 19

(Method)

A continuous printing operation was performed following the same procedures as in Experiment 15 except that a developer material as in Experiment 17 was used, and 1.0 wt% of a polymethylmethacrylate fine powder having a particle size of 0.2 μm was added to a replenishing toner.

(Results)

Formation of the afterimage on the image was not found until the number of prints reached 10,000. When the surface of the photosensitive drum 11 after the transfer operation was observed, the presence of the polymethylmethacrylate fine powder along the image pattern was found. The above experimental results are summarized in Table 4.

TABLE 4

| | Polymethylmethacrylate Fine Powder | | | |
|---|---|---|---|---|
| | *Amount (Parts by Weight) | Average Particle Size (μm) | Friction Charge Polarity | Evaluation of Image |
| Experiment 14 | No addition | | | x |
| Experiment 15 | 0.5 | 0.4 | Negative | o |
| Experiment 16 | 0.5 | 0.4 | Positive | x |
| Experiment 17 | 0.25 | 0.2 | Negative | o |
| Experiment 18 | ~2.5 | 2.0 | Negative | x |

o: Good x: Bad
*With respect to 225 parts by weight of carrier and 25 parts by weight of toner According to these experimental results, by using the developer material obtained by a light-transmitting fine powder which could be frictionally charged to the same polarity as that of the toner upon friction with the carrier, a good image free from image defects such as the afterimage phenomenon and degradation of the image density can be stably obtained in the image formation process without cleaning. In this case, the light-transmitting fine powder preferably consists of a polymethylmethacrylate fine powder having a particle size sufficiently smaller than that of the toner.

The transfer process using a developer material containing the light-transmitting fine powder will be described with reference to FIG. 10.

Figure 10:
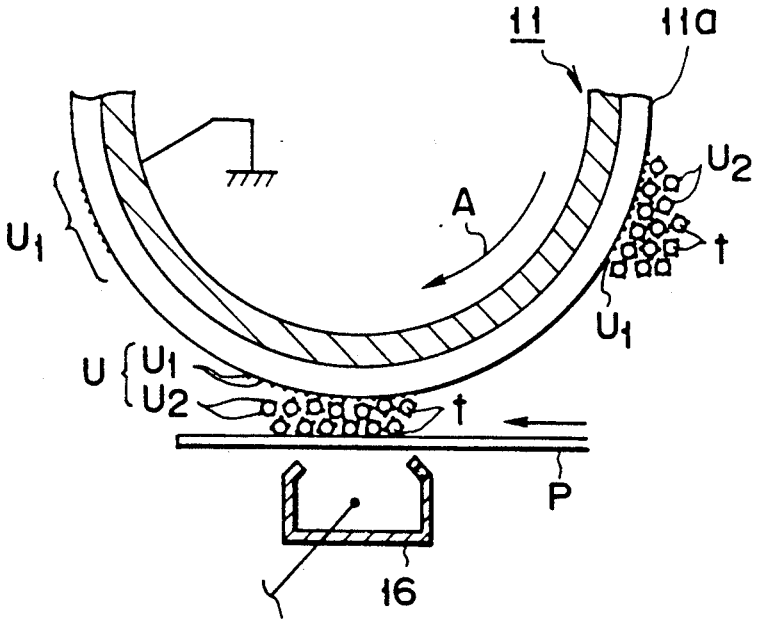
FIG. 10 is a schematic sectional view for explaining the step of transferring a toner image when a developer material containing a light-transmitting fine powder as a transfer accelerator is used.

Referring to FIG. 10, a light-transmitting fine powder u applied to the photosensitive drum 11 is preferentially attached to the surface of the photosensitive drum 11 to form a first layer. The light-transmitting fine powder u is also attached to the surface of the toner t constituting the second and subsequent layers. Since the toner t constitutes the second and subsequent layers through a light-transmitting fine powder layer $u_1$ as the first layer, an attraction force acting on the toner t with respect to the photosensitive drum 11 is weak. About 100% of the toner t can therefore be transferred to the sheet p by the transfer unit 16. In this case, a light-transmitting fine powder $u_2$ attached to the surface of the toner t is also transferred together with the toner to the sheet p, and an image corresponding to the toner is fixed. The sheet p having the fixed image is delivered outside the printer.

Although the light-transmitting fine powder layer $u_1$ as the first layer left on the surface of the photosensitive drum 11 is then subjected to charging and exposure again, formation of a latent image is not disturbed as described above. In the developing process, when the light-transmitting fine powder layer $u_1$ is located in a background portion (white image portion) of a new latent image, a developing electric field acts to repel the light-transmitting fine powder $u_1$ from the surface of the photosensitive drum 11. The removed light-transmitting fine powder $u_1$ is recovered in the developing unit 14 (FIG. 1). However, when the light-transmitting fine powder $u_1$ is located in an image portion (black image portion) of the new latent image, a new toner t is supplied to form a second layer on the light-transmitting fine powder layer $u_1$. In the transfer process, the second and subsequent toner layers are transferred to the sheet p, and the light-transmitting fine powder $u_1$ as the first layer is left on the surface of the photosensitive drum again. The light-transmitting fine powder $u_1$ left twice on the surface will be located in a white image portion and then recovered in the developing unit 14 (FIG. 1).

As described above, the light-transmitting fine powder u added to the developer material is classified into the light-transmitting fine powder $u_2$ attached to the sheet p and delivered outside the printer and the light-transmitting fine powder $u_1$ recovered in the developing unit 14 (FIG. 1). Therefore, when a continuous printing operation is performed for a long period of time while the toner t is replenished in accordance with the density of the toner contained in a developer material d, and when the content of the light-transmitting fine powder mixed in the replenishing toner t is equal to that mixed in an initial charge of developer material (i.e., a developer material which is already charged at the start of use of the developing device D), the content of the light-transmitting fine powder in the developer material d is gradually increased. When the content of the light-transmitting fine powder u in the developer material d exceeds an appropriate amount, the light-transmitting fine powder u in a two-component type developer material covers the entire surfaces of both the toner and the carrier. As a result, frictional charge of the toner becomes insufficient, and the toner particles are scattered or an image density becomes unstable. Therefore, the content of the light-transmitting fine powder u in the developer material d must be maintained at a predetermined mixing ratio.

In order to satisfy the above need, a light-transmitting fine powder must be replenished by an amount corresponding to that of the light-transmitting fine powder $u_2$ delivered outside the printer. Assume that an optimal content of the light-transmitting finepowder mixed in the initial charge of developer material is given as $\alpha$ wt% as a toner weight ratio, and that a ratio of the light-transmitting fine powder $u_2$ to the total light-transmitting fine powder u is given as $\beta$ %. When a ratio $\gamma$ of the light-transmitting fine powder mixed in the replenishing toner t is given as:

$$\gamma=\alpha\cdot\beta/100$$

the content of the light-transmitting fine powder u in the developer material d can be maintained almost at optimal ratio $\alpha$.

An experiment performed to confirm a method of using a light-transmitting resin fine powder suitable for the method of the present invention will be described below. A light-transmitting polymethylmethacrylate fine powder as a kind of an acrylic resin contained in a conventional toner as a binder was used as the light-transmitting fine powder suitable in the method of the present invention.

EXPERIMENT 20

(Method)

An initial charge of developer material was prepared by mixing the following components:

| | |
|---|---|
| N type toner (average particle size: 12.5 μm) | 25 parts by weight |
| Polymethylmethacrylate fine powder (prepared by emulsion polymerization) Charging polarity: negative Average molecular weight: 400,000 Average particle size: 0.4 μm | 0.5 parts by weight (2 wt % with respect to toner) |

and by mixing the resultant mixture with:

| | |
|---|---|
| Ferrite carrier (Cu—Zn—Mg; average particle size: 50–60 μm) | 225 parts by weight |

A transfer ratio $\beta$ of the polymethylmethacrylate fine powder was found to be about 70% according to the experiment of the present inventors. Therefore, the mixing ratio $\gamma$ of the polymethylmethacrylate fine powder was given as:

$$\gamma = 2 \times 70/100 = 1.4 \text{ wt\%}$$

The replenishing toner t obtained by adding 1.4 wt% of the polymethylmethacrylate fine powder with respect to the toner was replenished such that a toner concentration in the developer material d was about 10%, and continuous printing of 20,000 was performed by the printer of FIG. 1.

Other conditions were the same as those of Experiment 1.

(Results)

No afterimage was formed until the number of prints reached 20,000. Neither toner scattering nor a decrease in image density occurred, and a good image could be stably obtained.

EXPERIMENT 21

(Method)

A mixing ratio of the polymethylmethacrylate fine powder to the replenishing toner t was set to be equal (i.e., 2 wt%) to the initial developer material d, and continuous printing of 10,000 prints was performed.

(Results)

No afterimage was formed until the number of prints reached 10,000. However, toner scanning greatly occurred when the number of prints reached 5,000. Printing of 10,000 or more prints could not be continued In the usual image formation process, a substance supplied from the developing unit 14 to the photosensitive drum surface 11*a* is not limited to only the toner. When an operator changes a developing bias voltage in order to control an image density, a substance which is charged to a polarity opposite to that of the toner (this substance may be a carrier or the like in a two-component type developer material) may be attached to the surface of the photosensitive drum 11. The substance having a polarity opposite to that of the toner is not transferred by the transfer unit 16 but is left on the photosensitive drum surface 11*a*. In this case, this substance tends to be attached mainly to a portion near the edge of the image portion. When the image formation process is repeated without cleaning, afterimages corresponding to edges of the images are formed. Therefore, the light-transmitting fine powder must be attached to the photosensitive drum surface 11*a* before a substance such as a carrier which is charged to a polarity opposite to that of the toner is attached thereto. In order to satisfy this requirement, the present inventors found that the light-transmitting powder must have both the positive and negative polarities. It is impossible to charge one particle to both the negative and positive polarities. However, it is possible to mix different portions of the same substances which are charged to opposite polarities, thereby expecting a bipolar effect.

The examination and experiment for specifying the physical properties of the polymethylmethacrylate fine powder suitable for the method of the present invention will be described below. An effect obtained by adding a polymethylmethacrylate fine powder varies depending on particle sizes, frictional charge characteristics, and contents. The present inventors made experiments by taking the above three factors into consideration.

EXPERIMENT 22

Image formation was performed by the printer of FIG. 1 according to the reversal development using a two-component type developer material prepared by charging the following components in a 1 liter polyethylene bottle and sufficiently mixing the components on a rotary table:

| | |
|---|---|
| Ferrite carrier (Cu—Zn—Mg; average particle size: 50–60 μm; volume resistivity: $1 \times 10^8\ \Omega \cdot$ cm) | 225 parts by weight |
| N type toner (average particle size: 12.5 μm) | 25 parts by weight |

In this case, the developing bias potential was changed into −400 V, −350, −300 V, and −250 V, the resultant images were visually observed to determine the presence/absence of an afterimage.

Other experimental conditions were the same as those in Experiment 1.

EXPERIMENT 23

An experiment was performed following the same procedures as in Experiment 21 except that a developer material was prepared by mixing the following components by a Henschel mixer in advance:

| | |
|---|---|
| N type toner (average particle size: 12.5 μm) | 25 parts by weight |
| Polymethylmethacrylate fine powder (prepared by emulsion polymerization) Charging polarity: negative Average molecular weight: 400,000 Average particle size: 0.2 μm | 0.25 parts by weight (1 wt % with respect to toner) |

and the resultant mixture was mixed with:

| | |
|---|---|
| Ferrite carrier (Cu—Zn—Mg; average particle size: 40–60 μm: volume resistivity: $1 \times 10^8$ Ω · cm) | 225 parts by weight |

EXPERIMENT 24

Printing was performed following the same procedures as in Experiment 23 except that a ferrite carrier having a volume resistivity of $2 \times 10^9$ Ω·cm was used in place of the ferrite carrier in the developer material used in Experiment 23.

EXPERIMENT 25

Printing was performed following the same procedures as in Experiment 23 except that a developer material as in Experiment 23 was added with:

| | |
|---|---|
| Polymethylmethacrylate fine powder (prepared by emulsion polymerization Charging polarity: positive (metal treatment) Average molecular weight: 400,000 Average particle size: 0.2 μm | 0.1 parts by weight (0.4 wt % with respect to toner) |

EXPERIMENT 26

Printing was performed following the same procedures as in Experiment 25 except that a ferrite carrier (volume resistivity: $2 \times 10^9$ Ω·cm) as in Experiment 24 was used in place of the ferrite carrier (volume resistivity: $1 \times 10^8$ Ω·cm) in the developer material used in Experiment 25.

EXPERIMENT 27

Printing was performed following the same procedures as in Experiment 23 except that a toner weight ratio was increased to 30 parts by weight and a weight ratio of the polymethylmethacrylate fine powder was increased to 0.3 parts by weight in the developer material of Experiment 23, thereby preparing a new developer material.

EXPERIMENT 28

Printing was performed following the same procedures as in Experiment 23 except that a toner ratio was increased to 30 parts by weight and weight ratio of the two types of polymethylmethacrylate fine powders used in Experiment 25 were increased to 0.3 parts by weight (negative) and 0.12 parts by weight (positive), thereby preparing a new developer material.

The above experimental conditions and results are summarized in Tables 5 and 6 below.

TABLE 5

| | Resistivity of Carrier* | Toner (parts by weight) | **Polymethyl methacrylate | |
|---|---|---|---|---|
| | | | Positive | Negative |
| Experiment 22 | $1 \times 10^8$ | 25 | None | None |
| Experiment 23 | $1 \times 10^8$ | 25 | None | 0.25 |
| Experiment 24 | $2 \times 10^9$ | 25 | None | 0.25 |
| Experiment 25 | $1 \times 10^8$ | 25 | 0.1 | 0.25 |
| Experiment 26 | $2 \times 10^9$ | 25 | 0.1 | 0.25 |

TABLE 5-continued

| | Resistivity of Carrier* | Toner (parts by weight) | **Polymethyl methacrylate | |
|---|---|---|---|---|
| | | | Positive | Negative |
| Experiment 27 | $1 \times 10^8$ | 30 | None | 0.3 |
| Experiment 28 | $1 \times 10^8$ | 30 | 0.12 | 0.3 |

*Amount of Carrier: 225 parts by weight Volume resistivity in Ω · cm Measured value in an electric field of 1000 V/cm

**Amount of Polymethyl methacrylate in parts by weight

TABLE 6

| | Developing Bias Potential | | | |
|---|---|---|---|---|
| | −250 V | −300 V | −350 V | −400 V |
| Experiment 22 | x | x | x | x |
| Experiment 23 | Δ | ○ | ○ | ○ |
| Experiment 24 | x | Δ | ○ | ○ |
| Experiment 25 | ○ | ○ | ○ | ○ |
| Experiment 26 | ○ | ○ | ○ | ○ |
| Experiment 27 | x | Δ | ○ | ○ |
| Experiment 28 | ○ | ○ | ○ | ○ |

○: No Afterimage

Δ: Afterimage phenomenon slightly occurs x: Afterimage phenomenon apparently occurs When the results of Experiments 23 and 24 are compared, an afterimage tends to be formed more easily in Experiment 24 because the volume resistivity of the carrier in Experiment 24 is larger than that in Experiment 23. That is, when the carrier having a larger resistivity excessively decreases the developing bias potential (i.e., a potential difference between the image portion and the background portion is increased), and the residue tends to attach to a portion near the edge of the image portion on the photosensitive drum.

The resistivity of the carrier in the developer material of Experiment 26 is as large as that in Experiment 24. However, an afterimage is not formed even if the developing bias potential is not changed because the polymethylmethacrylate fine powder having the polarity (positive) opposite to that of the toner is attached to the portion near the edge of the image portion before the carrier is attached thereto.

By using the two-component type developer material obtained by mixing the polymethylmethacrylate fine powder charged to the negative polarity by friction with the carrier and the polymethylmethacrylate fine powder charged to the positive polarity, a good image free from an afterimage within an allowable variable range of the developing bias potential can be stably obtained in the image formation process without cleaning regardless a change in toner density and a change in volume resistivity of the carrier.

According to the present invention as has been described above, a predetermined transfer accelerator is added to a developer material containing a toner to maintain almost 100% transfer efficiency for transferring the toner to the transfer medium. Therefore, the method of the present invention allows a simple image formation process obtained by omitting the cleaning process from the normal electrophotographic image formation processes. Therefore, a cleaner need not be arranged in an image formation apparatus, and a compact apparatus can be obtained.

What is claimed is:

1. A method of forming an image without cleaning on the basis of repeated electrophotographic process cycles, each process cycle including the steps of:

charging a surface of a photosensitive body to a predetermined polarity;

irradiating the charged surface of the photosensitive body with light which carries image information, thereby forming a latent image corresponding to the image information;

visualizing the latent image using a dry developer material; and transferring the visualized image from the surface of the photosensitive body to a transfer medium, wherein the developer material contains a toner, and also a transfer accelerator comprising a light-transmitting powder composed of first and second fine powders which have opposite frictional charging polarities and each of which has an average particle size smaller than that of the toner, both said first and second fine powders consisting essentially of an acrylic polymer, said light-transmitting fine powder improving efficiency of transfer of the visualized image onto the transfer medium.

2. A method according to claim 1, further including the step of replenishing the developer material with a replenishing developer material when the initially charged amount of the developer material is decreased, the replenishing developer material containing a toner and a transfer accelerator comprising a light transmitting powder containing first and second fine powders which have opposite frictional charging polarities and each of which has an average particle size smaller than that of the toner and consists essentially of an acrylic polymer for improving the efficiency of transfer of the visualized image onto the transfer medium, the replenishing developer material having a content of the light-transmitting fine powder smaller than that in the initially charged developer material.

3. A method according to claim 1, wherein said toner is frictionally charged to the same polarity as that of the charged photosensitive body.

4. A method according to claim 1, wherein said light-transmitting fine powder has an average particle size of 0.2 to 0.4 micrometers.

* * * * *